US010077954B2

(12) United States Patent
Woollen et al.

(10) Patent No.: US 10,077,954 B2
(45) Date of Patent: Sep. 18, 2018

(54) HEAT EXCHANGER ASSEMBLY

(71) Applicants: DENSO CORPORATION, Kariya, Aichi-pref. (JP); DENSO Marston Ltd., Shipley, West Yorkshire (GB)

(72) Inventors: Neil Woollen, Tadcaster (GB); Mario Ciaffarafa, Keighley (GB)

(73) Assignees: DENSO CORPORATION, Kariya, Aichi-pref. (JP); DENSO Marston Ltd., Shipley, West Yorkshire (GB)

( * ) Notice: Subject to any disclaimer, the term of this patent is extended or adjusted under 35 U.S.C. 154(b) by 522 days.

(21) Appl. No.: 14/439,421

(22) PCT Filed: Oct. 29, 2013

(86) PCT No.: PCT/JP2013/006393

§ 371 (c)(1),
(2) Date: Apr. 29, 2015

(87) PCT Pub. No.: WO2014/068957

PCT Pub. Date: May 8, 2014

(65) Prior Publication Data

US 2015/0292819 A1 Oct. 15, 2015

(30) Foreign Application Priority Data

Oct. 30, 2012 (GB) ..... 1219504.6

(51) Int. Cl.

| | |
|---|---|
| ***F28F 7/00*** | (2006.01) |
| ***F28F 9/02*** | (2006.01) |
| ***F28F 9/00*** | (2006.01) |

(52) U.S. Cl.

CPC ..... *F28F 9/028* (2013.01); *F28F 9/001* (2013.01); *F28F 9/02* (2013.01); *F28F 2275/085* (2013.01)

(58) Field of Classification Search

CPC ..... F28F 9/0219; F28F 9/028; F28F 9/001; F28F 9/002; F28F 2275/085

(Continued)

(56) References Cited

U.S. PATENT DOCUMENTS 2,231,153 A * 2/1941 Camiener ..... B60R 13/0206 248/231.9
3,894,580 A * 7/1975 Chartet ..... F28F 9/001 165/67

(Continued)

FOREIGN PATENT DOCUMENTS

DE 3228617 A1 2/1983
DE 3937463 A1 5/1990

(Continued)

OTHER PUBLICATIONS

International Search Report and Written Opinion for PCT/JP2013/006393, dated Feb. 5, 2014; ISA/EP.

(Continued)

*Primary Examiner* — Claire Rojohn, III
(74) *Attorney, Agent, or Firm* — Harness, Dickey & Pierce, P.L.C.

(57) ABSTRACT

The present disclosure relates to an assembly forming a heat exchanger or part of a heat exchanger. The assembly comprises a core with at least one insert in the form of a side plate, and a header plate attached to the or each insert by at least one snap fit connection. Accordingly, the assembling process of the assembly can be facilitated, and cost of the assembly can be reduced.

29 Claims, 14 Drawing Sheets

(58) Field of Classification Search
USPC ..... 165/76
See application file for complete search history.

(56) References Cited

U.S. PATENT DOCUMENTS

| | | | | | |
|---|---|---|---|---|---|
| 4,041,594 | A * | 8/1977 | Chartet | B21D 53/08 | 165/151 |
| 4,465,124 | A * | 8/1984 | Jacquet | B60H 1/00521 | 165/149 |
| 4,544,029 | A * | 10/1985 | Cadars | F28F 9/0226 | 165/149 |
| 4,738,308 | A * | 4/1988 | Moranne | F28D 1/05333 | 165/149 |
| 5,180,006 | A | 1/1993 | Marsais et al. | | |
| 5,186,239 | A * | 2/1993 | Young | B60K 11/04 | 165/149 |
| 5,311,933 | A | 5/1994 | Lee | | |
| 5,404,940 | A * | 4/1995 | van den Nieuwenhuizen | F28D 1/05366 | 165/149 |
| 5,579,833 | A | 12/1996 | Wijkstrom | | |
| 5,931,223 | A * | 8/1999 | Yu | F28D 1/05366 | 165/149 |
| 6,006,430 | A * | 12/1999 | Fukuoka | B23K 1/0012 | 165/149 |
| 6,269,868 | B1 * | 8/2001 | Welding | B23K 1/0012 | 165/149 |
| 6,357,520 | B1 * | 3/2002 | Kato | F28F 9/001 | 165/149 |
| 2002/0029872 | A1 * | 3/2002 | Jamison | F28D 1/0316 | 165/153 |
| 2002/0079091 | A1 * | 6/2002 | DeGroot | F28F 9/001 | 165/149 |
| 2002/0134536 | A1 * | 9/2002 | Nozaki | F28D 1/05366 | 165/149 |
| 2002/0144808 | A1 | 10/2002 | Jones | | |
| 2003/0075305 | A1 * | 4/2003 | Sanada | B60H 1/3229 | 165/67 |
| 2005/0016717 | A1 * | 1/2005 | Lamich | F28F 9/001 | 165/149 |
| 2005/0150636 | A1 * | 7/2005 | Hongwu | F28D 15/02 | 165/104.33 |
| 2005/0230089 | A1 | 10/2005 | Ozaki | | |
| 2006/0196635 | A1 * | 9/2006 | Lesage | B21D 53/085 | 165/76 |
| 2009/0188653 | A1 * | 7/2009 | Xu | F28F 9/001 | 165/148 |
| 2009/0255657 | A1 | 10/2009 | Hakamata et al. | | |
| 2011/0214848 | A1 * | 9/2011 | Ninagawa | F28F 9/001 | 165/148 |

FOREIGN PATENT DOCUMENTS

| | | | | |
|---|---|---|---|---|
| EP | 1724546 | A2 | 11/2006 | |
| EP | 2085735 | A1 | 8/2009 | |
| FR | 2511138 | A1 * | 2/1983 | B29C 63/26 |
| FR | 2511138 | A1 | 2/1983 | |
| GB | 2090958 | A | 7/1982 | |
| JP | H03225197 | A | 10/1991 | |
| JP | 2004125333 | A | 4/2004 | |
| WO | WO-95/08089 | A1 | 3/1995 | |

OTHER PUBLICATIONS

Search Report in corresponding GB Application No. 1219504.6, dated Oct. 30, 2013.

* cited by examiner

HEAT EXCHANGER ASSEMBLY

CROSS REFERENCE TO RELATED APPLICATIONS

This application is a U.S. National Phase Application under 35 U.S.C. 371 of International Application No. PCT/JP2013/006393 filed on Oct. 29, 2013 and published as WO 2014/068957 A1 on May 8, 2014. This application is based on and claims the benefit of priority from Great Britain Patent Application No. 1219504.6 filed on Oct. 30, 2012. The entire disclosures of all of the above applications are incorporated herein by reference.

FIELD

The present disclosure relates to a heat exchanger assembly, such as for a radiator, an oil cooler, a charge air cooler, a condenser, or the like, in particular the connection of the insert to the header plate of the heat exchanger.

BACKGROUND

Heat exchangers are well known. Typically, a heat exchanger has a core, which may be a tube fin type core, and an insert on each side of the core. Conventionally, the insert to header plate connection is achieved by a multi stage process. Such steps in the assembly process add time to the production cycle and often require specialist tools for example where crimping of a flange is required. Further, such connections are often prone to errors and manufacturing concessions occur. Two such connections are described in JP2004125333 and DE3937463 (A1).

[PTL 1]
JP 2004-125333 A
[PTL 2]
DE 3937463 A1

SUMMARY

It is an object of this disclosure to provide an assembly forming a heat exchanger or part of a heat exchanger, which is capable of facilitating its assembling process and reducing cost.

According to the first aspect of the disclosure there is provided an assembly forming a heat exchanger or part of a heat exchanger, the assembly comprising a core with at least one insert in the form of a side plate, and a header plate attached to the or each insert by at least one snap fit connection.

The term insert used herein is a term of art for a feature also sometimes called a side plate, core plate, side member or inner side member. The term header plate used herein is a term of art for a feature also sometimes called a top plate or a tube plate. The heat exchanger may be any suitable heat exchanger, typically for a vehicle, such as an automotive radiator. The header plate is a component of the heat exchanger which is arranged to supply a coolant to and from a series of tubes fitted therein. The snap fit connection allows the insert to be assembled to the header plate in one action and removes the need for subsequent production steps to complete the connection, such as part deformation or welding.

The header plate may include a flange which overlaps the side plate and is connected thereto.

This avoids the potential problem of leakage in the prior art which stems from creation of a joint within the header tank. The flange may be a downwardly turned flange. This also maintains a small space envelope. The flange can also act as a guide for mounting the header plate on the core. This also strengthens the overall corner joint of the core with a more positive connection and greater contact area between header plate and insert.

Indeed, according to another aspect of the disclosure there is provided an assembly forming a heat exchanger or part of a heat exchanger, the assembly comprising a core with at least one insert in the form of a side plate, the header plate including a flange, the flange and side plate overlapping and being connected together.

The header plate is preferably attached to the or each insert by at least one snap fit connection.

Preferably one of the insert and header plate defines at least one protrusion and the other defines at least one stop, the or each protrusion latching behind the or one stop to form the snap fit connection. The or each stop may be part of a surface defining an aperture. In one embodiment there is a single protrusion and a single stop, in another embodiment there are two protrusions and two stops, and in a further embodiment there are more than two protrusions and more than two stops.

The stop may be on the insert or the header plate flange, and in a preferred embodiment the or each stop is on the flange.

The or each protrusion or stop may be provided on a resilient arm. The part carrying the arm may also include a web opposite the arm such that the arm and web can clamp the other part between them. This provides additional resistance to disconnection. Where two or more arms are provided, the land between two arms may include strengthening deformation such as an elongate ridge, which may be formed by swaging. This provides additional strength. The deformation may extend beyond the root of the arms. In a preferred embodiment, the deformation extends about the same distance in each direction from the root of the arms. This ensures that the whole of the area undergoing stress from resilient bending of the arms is strengthened.

Preferably, the or each protrusion is connected to an angled lead-in. The angled lead-in ensures ease of connection of the snap fit connection. The or each protrusion and angled lead-in forms a barb. A reverse taper may be employed. The end of the lead-in may be hemmed. This acts to provide a more positive lead-in.

Preferably, the or each resilient arm abuts the fin when assembled. Having the resilient arm abut the fin increases the surface area of the insert in contact with the fin resulting in further increase in structural integrity of the connection following brazing.

Preferably, the insert further comprises a part spanning the or each resilient arm. This provides greater stiffness. The part may also prevent the or each resilient arm from over bending to prevent against plastic deformation. The spanning part may comprise a cage outside the or each arm. This allows, in the core, the fins to support the end tubes all the way into the corner of the core. Additionally or alternatively, the spanning part may comprise a link behind the or each arm.

Preferably, the ratio between the material gauge of the arm and the resilient arm length from root to protrusion is between 7 and 253. The ratio may be reduced to an exemplary range of 31 to 83 for a material such as aluminium. The material gauge versus resilient arm length ratio ensures that the deformation only occurs in the elastic range so optimising the balance between stressing within the elastic limit and provision for enough spring back force to maintain engagement of the protrusion with the stop.

In a preferred embodiment, one part defines a pocket to retain a part on the other. This non-sprung connection improves the quality of the final braze joint. In one embodiment, the insert comprises a flange retainer pocket. The flange retainer pocket may receive a part of the header plate, and thereby maintain the contact between the insert and the header plate. During brazing this is advantageous in order to improve brazing of the connection when components of the core contract at different rates.

In one embodiment, the header plate comprises a flange in contact with the insert, the or each resilient arm is formed from the flange, the stop is a cut-out from the flange, and the protrusion is a tapered portion of the insert. The flange acts as a guide while the insert is being connected to the header plate. Forming the resilient arm from the flange ensures that structural integrity is maximised and simplifies braze jigging and part tooling. Preferably, the flange comprises a lead-in. The lead-in allows for an easier connection when slid over the core and inserts.

Alternatively, the header plate comprises a flange in contact with the insert, the or each resilient arm is formed in the insert, the stop is a cut-out from the flange, and the stop is a tapered portion of the flange. Forming the resilient arm from the insert ensures that structural integrity is maximised rather than utilising a separate component or process.

Preferably, the insert comprises one or more stiffeners. These stiffeners help to strengthen the insert and possibly allow for a reduction in overall material usage.

Additional material may be added as a hem. A hem may be provided on the outside and additionally or alternatively on the inside of the lands between resilient arms and/or to either side of the or each resilient arm. Such a hem provides additional strength and can aid location on the header plate.

The or each resilient arm may comprise at least one joggle. This allows more extensive contact with the fins thus enabling a better brazed joint. The or one joggle is at the protrusion and can be arranged to avoid the fouling of the internal radius of the protrusion with the corner of the stop.

The insert may be in the form of an elongate channel. This improves the rigidity of the insert and strengthens the assembly. The side walls of the channel may extend away from the core.

The heat exchanger assembly may be made of any suitable material or combination of materials and may be made from steel, brass or copper, but in a preferred embodiment, the assembly is made from aluminium.

BRIEF DESCRIPTION OF DRAWINGS

Embodiments of the disclosure will now be described by way of example with reference to the accompanying drawings, in which.

DESCRIPTION OF EMBODIMENT

Example embodiments will now be described more fully with reference to the accompanying drawings. The following description is merely exemplary in nature and is not intended to limit the present disclosure, application, or uses.

First Embodiment

With reference to FIGS. 1 to 4, a heat exchanger assembly 10, according to a first embodiment of the present disclosure, comprises a core 12, header plate 14 and inserts 20, in the form of side plates.

The parts are assembled by machine ready for brazing. The connection must be robust so that the parts stay attached during further processing, such as jigging and brazing.

Figure 1:
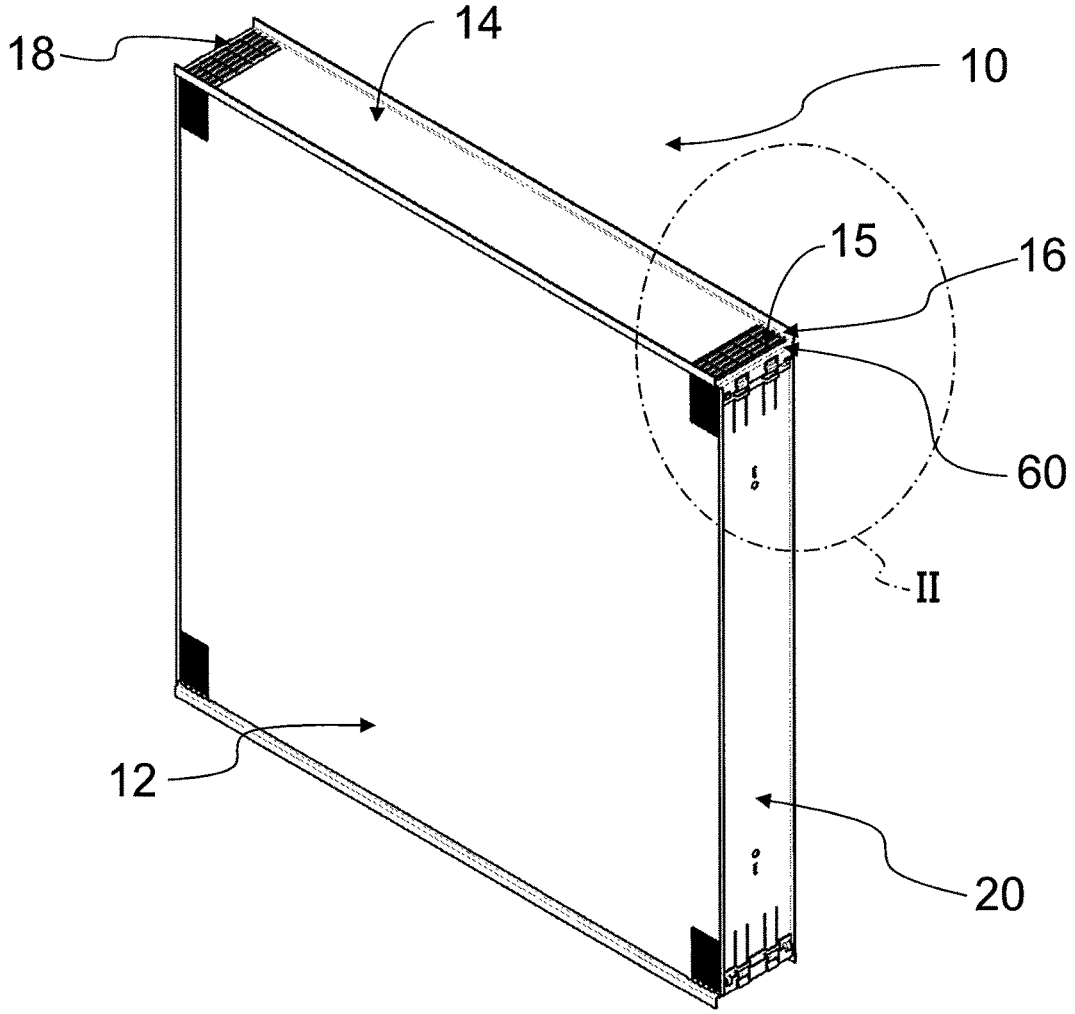
FIG. 1 is a perspective view of a heat exchanger assembly according to a first embodiment of the present disclosure.

The core 12 comprises a series of substantially parallel tubes having an arrangement of fins disposed therebetween. FIG. 1 shows the tubes and fins only in the corners but they occupy the entire side of the core 12. The tubes slot into a header plate 14. The header plate apertures 15 and tubes are only shown at each end, but the apertures and tubes extend over the whole length of the header plate 14. The header plate 14 is arranged to be attached to a tank for connection to a duct (not shown) leading to a heat producing apparatus, such as an internal combustion engine or the like. The header plate 14 has a first end 16 and a second end 18. An insert 20 is connected to the header plate 14 at each end 16, 18.

Figure 2:
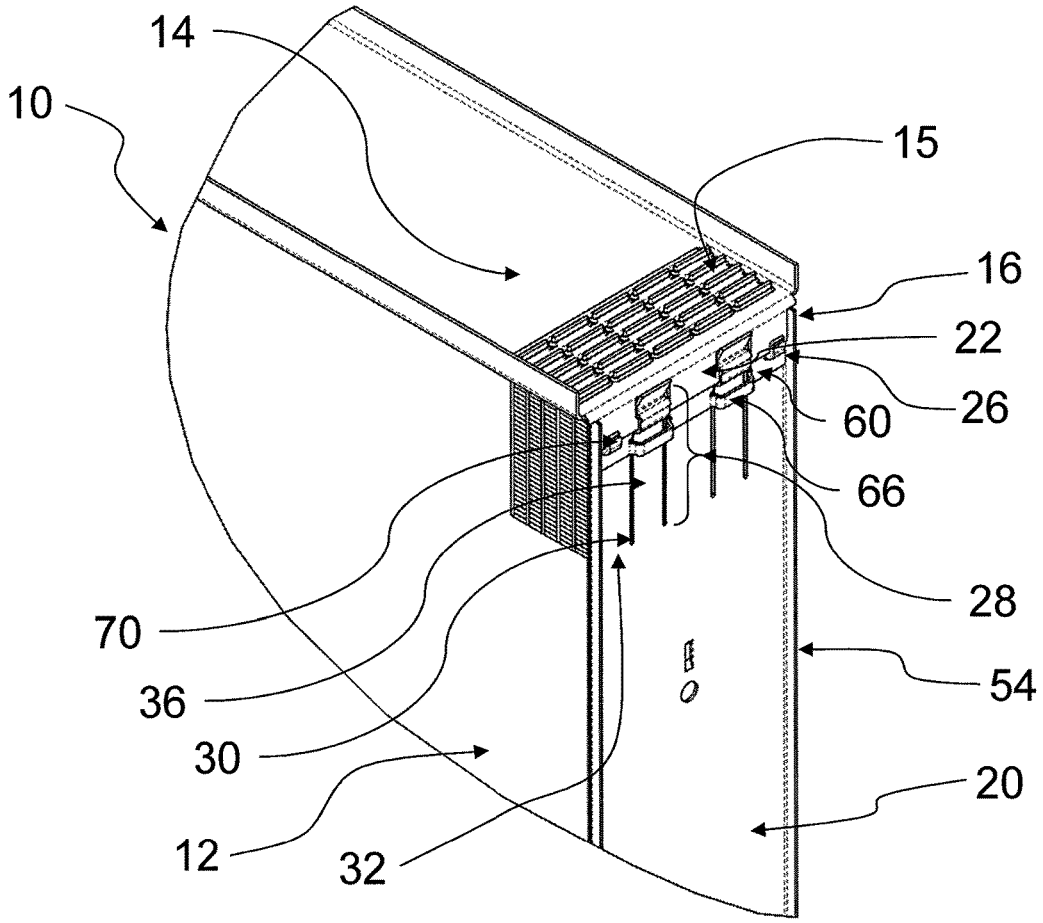
FIG. 2 is a perspective detail fragmentary view of part II of the heat exchanger assembly of FIG. 1.
Figure 3A:
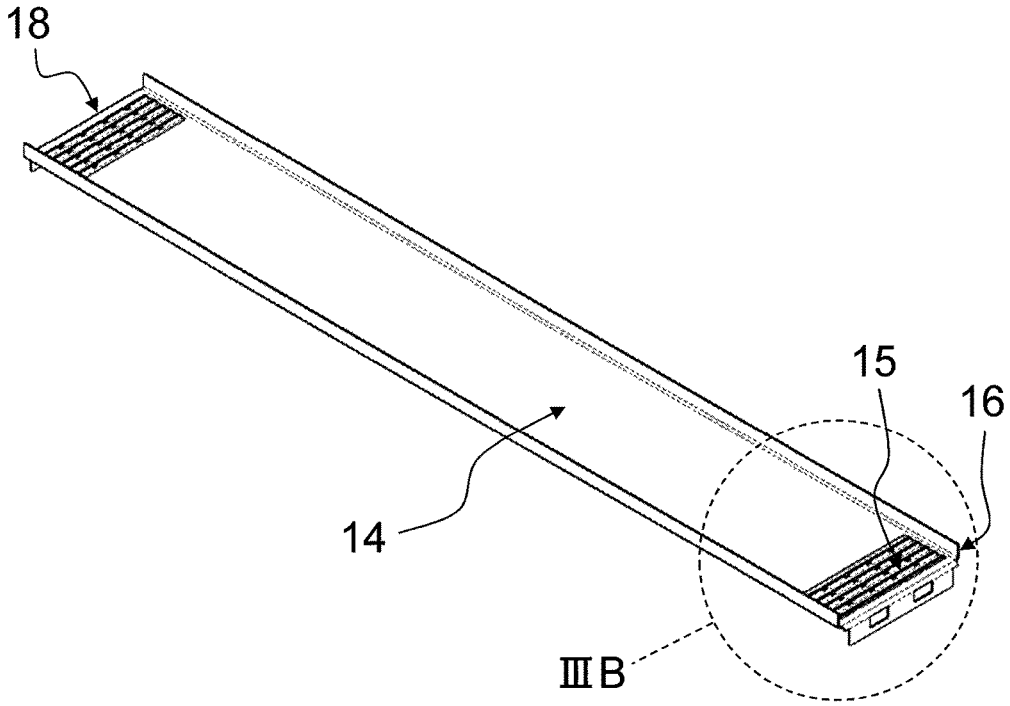
FIG. 3A is a perspective view of a header plate of the heat exchanger assembly according to the first embodiment.
Figure 3B:
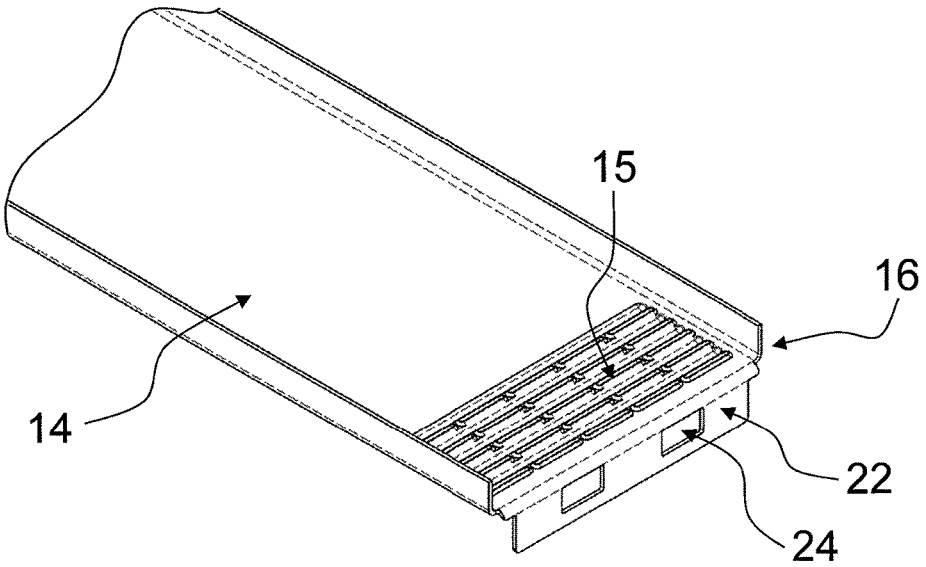
FIG. 3B is a perspective detail fragmentary view of part IIIB of FIG. 3A.
Figure 4:
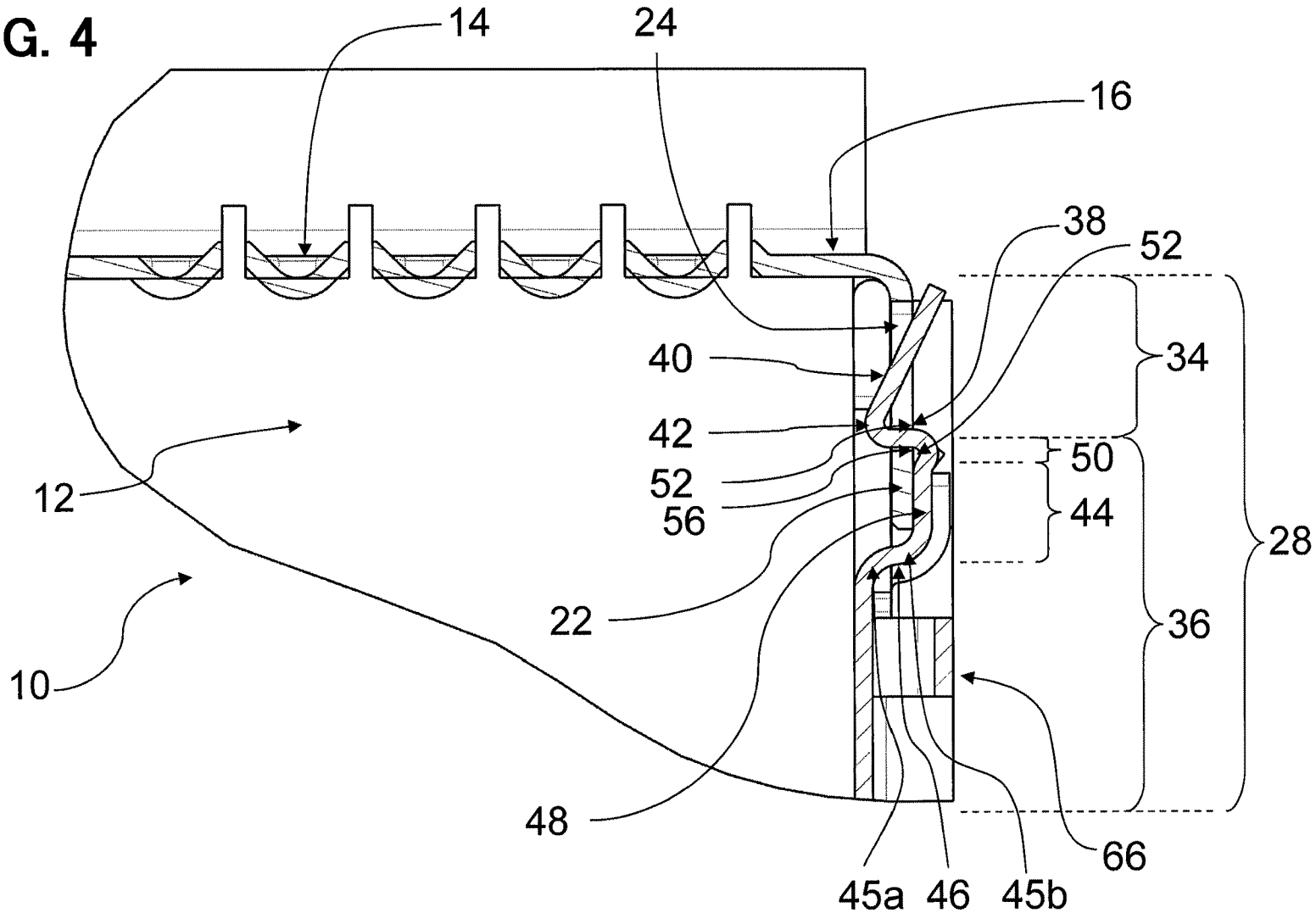
FIG. 4 is an elevation in cross section of part II of the heat exchanger assembly of FIG. 1.

With reference to FIGS. 2 to 4, the header plate 14 includes a downwardly turned flange 22 at each of the first and second ends 16, 18, such that each flange lies substantially normal to the main body of the header plate 14. Each flange 22 propagates in the direction of, and is external to, the insert 20, when assembled. Each flange 22 includes two cut-outs 24 (e.g., aperture). The insert 20 has a tip 26 and includes two corresponding resilient arms 28 located in the vicinity of the tip 26, and a land between the resilient arms 28. Each resilient arm is arranged to abut the core 12 and is formed between a pair of substantially parallel cuts 30 longitudinally along the insert 20 from the tip 26. The cuts 30 start at the tip 26 of the insert and end at a location forming a root 32 of the resilient arm 28. The resilient arms 28 are thus formed generally in the same plane as the main body of the insert 20.

The insert 20 includes a hemmed tip 60 (first hem), which is bent away from the core 12 and down such that the hem lies against the outer surface of the insert 20. To accommodate the hemmed tip 60, the end of the insert 20 is over sized compared to the final length of the insert. Prior to hemming, a U shaped cut 30 is made for creating each resilient arm 28 and each arm of the U extends from the intended root 32 to a point before the end of the pre fabricated insert. The remaining material adjacent the cut 30 forms a strip which is bent outwards away from the resilient arms 28 so that once the hem is formed the material creates a cage 66. The strip defines a cage 66 surrounding the resilient arms 28 on an external side of the insert 20. The cage 66 is attached to the insert 20 at locations either side of the resilient arms 28 but propagates in an external direction to the heat exchanger assembly 10 at the locations of the resilient arms 28. The cage 66 is an example of a part of the insert 20 which spans the resilient arms 28. The cage 66 can prevent over bending of the resilient arms 28 to limit the possibility of plastic deformation. The cage 66 also stiffens the insert 20 where it has been weakened by the cuts 30. The cage 66 further protects the resilient arms 28 during handling, and ensures the parts stay aligned. The parts of the strip between the cages 66 also strengthen the insert 20 in those areas. The insert 20 may include stiffeners. The cage 66 may be used as an example of the stiffeners of the insert 20.

With reference to FIG. 4, each resilient arm 28 comprises a barb 34 and a leaf spring 36. The length of the leaf spring 36 is defined as the length of the arm 28 between the root 32 and the barb 34. The barb 34 comprises a protrusion 38 and a lead-in 40, the protrusion 38 extending inwardly towards the core 12. The lead-in 40 is arranged at an acute angle with respect to the protrusion 38 and bends away from the core 12. It will be appreciated that the angle of the lead-in 40 with respect to the protrusion 38 forms an apex 42 therebetween. The barb 34 may include a reverse taper. For example, the lead-in 40 may be hemmed. The leaf spring 36 includes a first joggle 44 and a second joggle 50. The first joggle 44 comprises first and second bends 45*a*, 45*b*. The first bend 45*a* turns the arm 28 outwardly into an outwardly extending portion 46 of the first joggle 44, the outwardly extending portion 46 being substantially perpendicular to the main body of the insert 20. The second bend 45*b* turns the arm 28 back parallel to the main body of the insert 20 and leads into a contact portion 48, substantially parallel to the main body of the insert 20. The arm 28 further comprises the second joggle 50. The second joggle 50 extends from the upper end of the contact portion 48. The first bend of the second joggle 50 initially turns the arm 28 away from the core 12 and then immediately back towards the core 12 forming the aforementioned inwardly extending protrusion 38. The second bend of the second joggle 50 is the apex 42 between the protrusion 38 and lead-in 40. It will be appreciated that a radiussed channel 52 is formed behind the first bend of the second joggle 50.

The insert 20 includes an outwardly turned longitudinal flange 54 (elongate channel) on each side, so that it is generally in the shape of a channel.

The insert 20 includes a flange retainer pocket 70 at each side which forms an open sided cup shape. The flange retainer pocket 70 maintains the contact between the insert 20 and the header plate 14 when the two parts are connected. During brazing this is advantageous in order to improve the brazing connection when components of the core contract at different rates.

The insert 20 and the header plate 14 are assembled together by first aligning the header plate 14 with the core 12, with the flanges 22 externally to the inserts 20. The core 12 and the header plate 14 are then pressed together forcing the lead-ins 40 to slide up the flange 22. This action elastically deforms the leaf springs 36 such that they bend away from the flange 22. The maximum point of deflection of the resilient arms 28 occurs when the apex 42 abuts the flange 22. While the apex 42 is abutting the flange 22, the force in reaction to the displacement of the resilient arm 28 acts through the apex 42. The insert 20 and header plate 14 continue to be pressed together until apices 42 reach the cut-outs 24 at which point the resilient arms 28 snap back to a neutral position, substantially in the same plane as the main body of the insert, such that the protrusions 38 are inside the cut-outs 24. It will be appreciated that the contact portion 48 contacts the flange 22 when the resilient arm 28 is in the neutral position. The inner wall of the first bend of the second joggle 50, which defines the radiussed channel 52, lies separate from the flange 22 and allows the protrusions 38 to lie flush to the lower wall 56 of the cut-outs 24. It will be appreciated that the lower wall 56 of each cut-out 24 forms a stop to act as a catch and the protrusions 38 formed by the barbs 34 act as a latch. When assembled, the barbs 34 prevent the insert 20 from being separated from the header plate 14. It will therefore be appreciated that the stop and protrusion, or catch and latch, cooperate to form a snap-fit connector for securing the insert 20 to the header plate 14.

The longitudinal flanges 54 act as strengthening mechanisms to increase the structural integrity of the heat exchanger assembly 10, as well as making the parts more robust as they transit between subsequent process stages.

Figure 11:
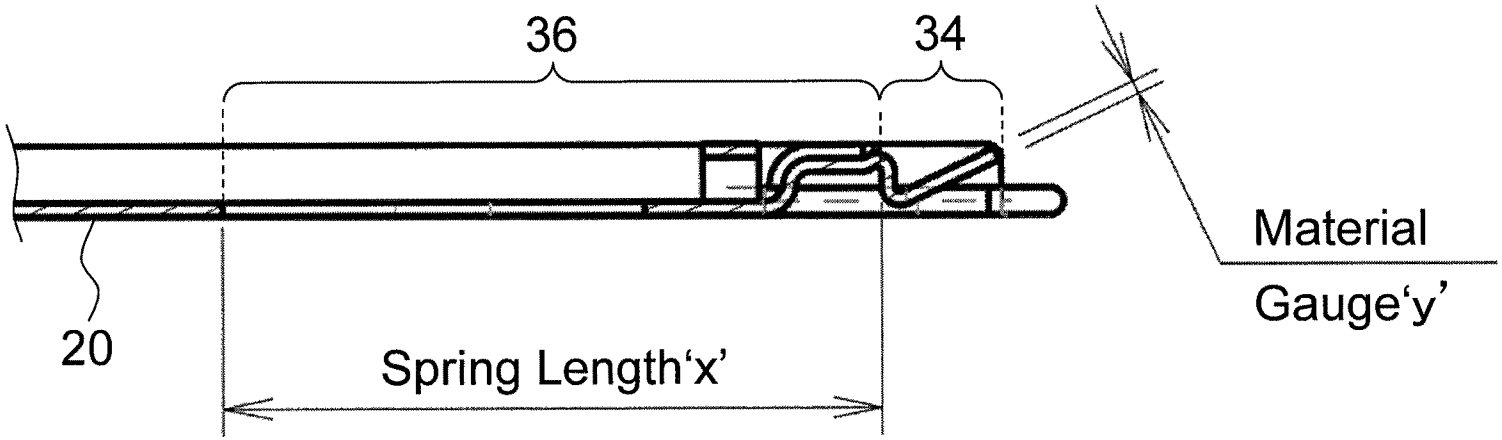
FIG. 11 is a side elevation in cross section showing dimensions x and y.

The heat exchanger assembly 10 is preferably fabricated from a good thermal conductor, typically metallic, such as steel, steel composites, brass or copper. The insert 20 and the header plate 14 are preferably, but not necessarily, made from similar aluminium alloys. Preferably, the insert 20 and header plate 14 are made from 3000 or 6000 series aluminium. The material gauge is preferably in the range from 0.5 mm to 3 mm. The ratio Z of spring length x to material gauge y, is important in this context, see FIG. 11. The ratio Z for aluminium is between 30:1 and 85:1. Z has been determined using empirical data. The lower limit is generally inversely proportional to the yield strength of the component, e.g. the lower the yield strength, the longer the resilient arm must be. The upper limit is a function of modulus of elasticity. The lower limit is considered of primary importance, compared to the upper limit, when considering the actual ratio, Z, to be employed.

In the present embodiment, the material gauge y is 1.4 mm and the spring length x is 70 mm, so the ratio is 50:1.

It will be appreciated that the insert may be made from materials other than aluminium. The range of the ratio, Z, for steel is for example between 7:1 and 253:1. It will be appreciated that such a large range is possible for steel because steel has higher stiffness and elasticity than aluminium.

Advantageously, the snap fit connector allows for the insert to be assembled to the header plate in one action and removes the need for subsequent production steps, such as part deformation or welding. Such a latch and catch system ensures the connection is repeatable across a batch of heat exchanger assemblies. The insert acts as a guide while the header plate is being connected to the insert. Forming the catch as a cut-out from the flange ensures that structural integrity is maximised without using additional processes. Forming the connection on the side of the core, away from the tank, prevents any possible leak problems in the area of the connection. It also keeps the space envelope occupied by the assembly small and compact. The material gauge versus spring length ratio, of between 7:1 to 253:1, or 30:1 to 85:1 depending on material employed, ensures that the deformation only occurs in the elastic range so that the connection is repeatable while optimising the balance between stressing within the elastic limit and provision for enough spring back force to maintain engagement of the barb.

The close connection between the insert and flange creates a good post-braze insert to header plate joint. The embodiment is applicable to heat exchangers using a plastic tank attached to the header plate, or heat exchangers using a metal tank, such as cast aluminium, which might be welded to the header plate, for example by a simple butt weld.

A non-exhaustive set of further embodiments will now be described. The further embodiments are similar to the first embodiment and only the differences will be described. All parts in common with earlier embodiments use the same reference numerals but prefixed with a 2 for the second embodiment, 3 for the third embodiment and so forth.

Second Embodiment

Figure 5:
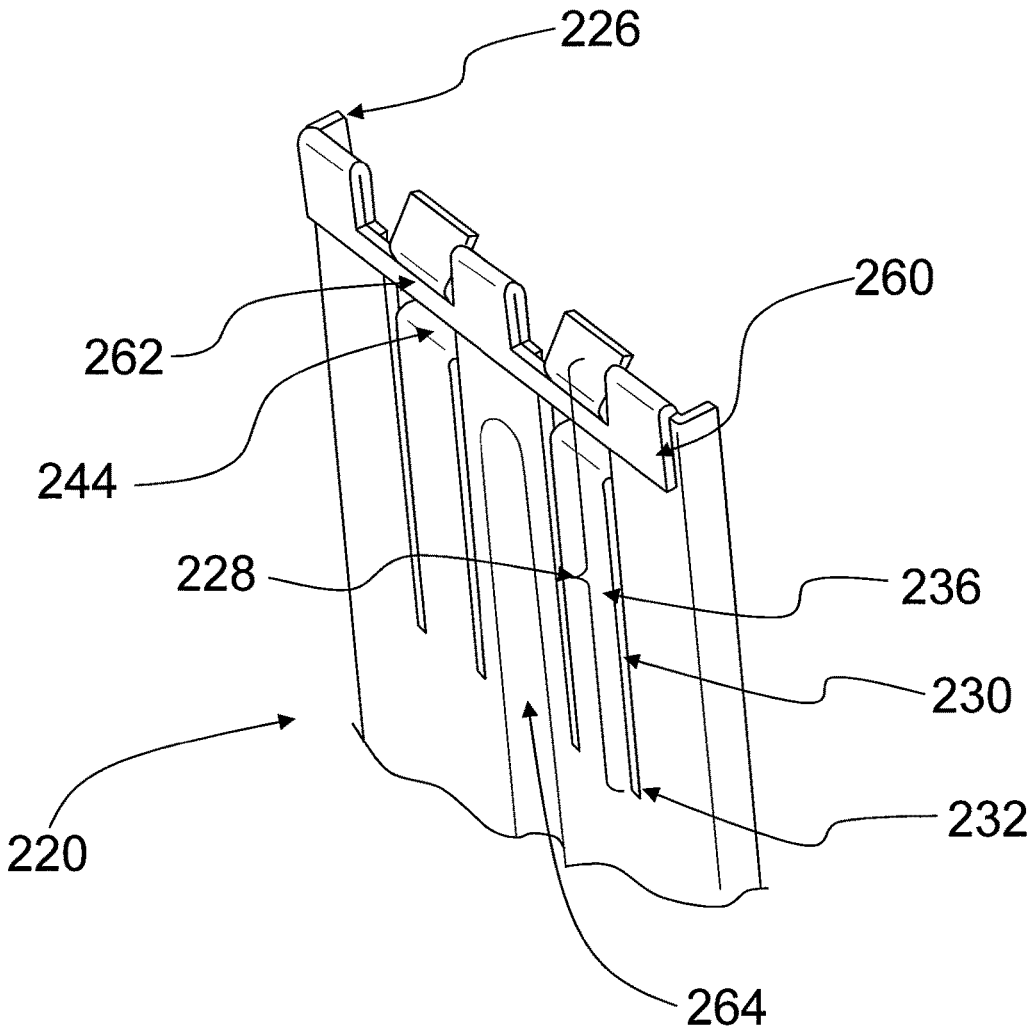
FIG. 5 is a perspective view of an insert of the heat exchanger assembly in a second embodiment of the present disclosure.

With reference to FIG. 5, in a second embodiment of the disclosure, the insert 220 is shown from a reverse angle to the previous figures. The insert 220 comprises a hemmed tip 260 (first hem). The hemmed tip 260 is formed by the end 226 of the insert 220 being folded in the opposite direction from the first embodiment, being folded inwards towards the core and down such that the hem lies against the inner surface of the insert 220. To accommodate the hemmed tip 260, the end of the insert 220 is over sized compared to the final length of the insert 220 prior to fabrication. In this second embodiment the cuts 230 made for creating the resilient arm 228 extend only from the root 232 to a point before the end of the pre fabricated insert 220. The remaining material at the end of the insert 220 forms a web 262, generally in the same plane as the insert 220, when the hemmed tip 260 has been formed during fabrication. The web 262 occupies a position opposite the contact surface (not shown in FIG. 5) of the joggle 244. The hemmed tip 260 acts to increase the strength of the insert end. The web 262 is a link behind the resilient arms and is an example of a part of the insert 220 which spans the resilient arm.

The insert 220 further comprises strengthening deformation in the land between the two leaf springs 236 (two resilient arms). For example, the insert 220 further comprises a swaged ridge 264 in the form of a longitudinal swage. The swaged ridge 264 is formed by swaging and extends beyond the root 232 along the insert 220 intermediate the two leaf springs 236. The swaged ridge 264 extends about the same distance in each direction from the root 232. The swaged ridge 264 is an example of an elongate ridge formed in the land between the resilient arms.

The hemmed tip 260 and the swaged ridge 264 provide additional strength to the insert 220. The swaged ridge 264 and the hemmed tip 260 may be used as an example of the stiffeners of the insert 220.

Third Embodiment

Figure 6:
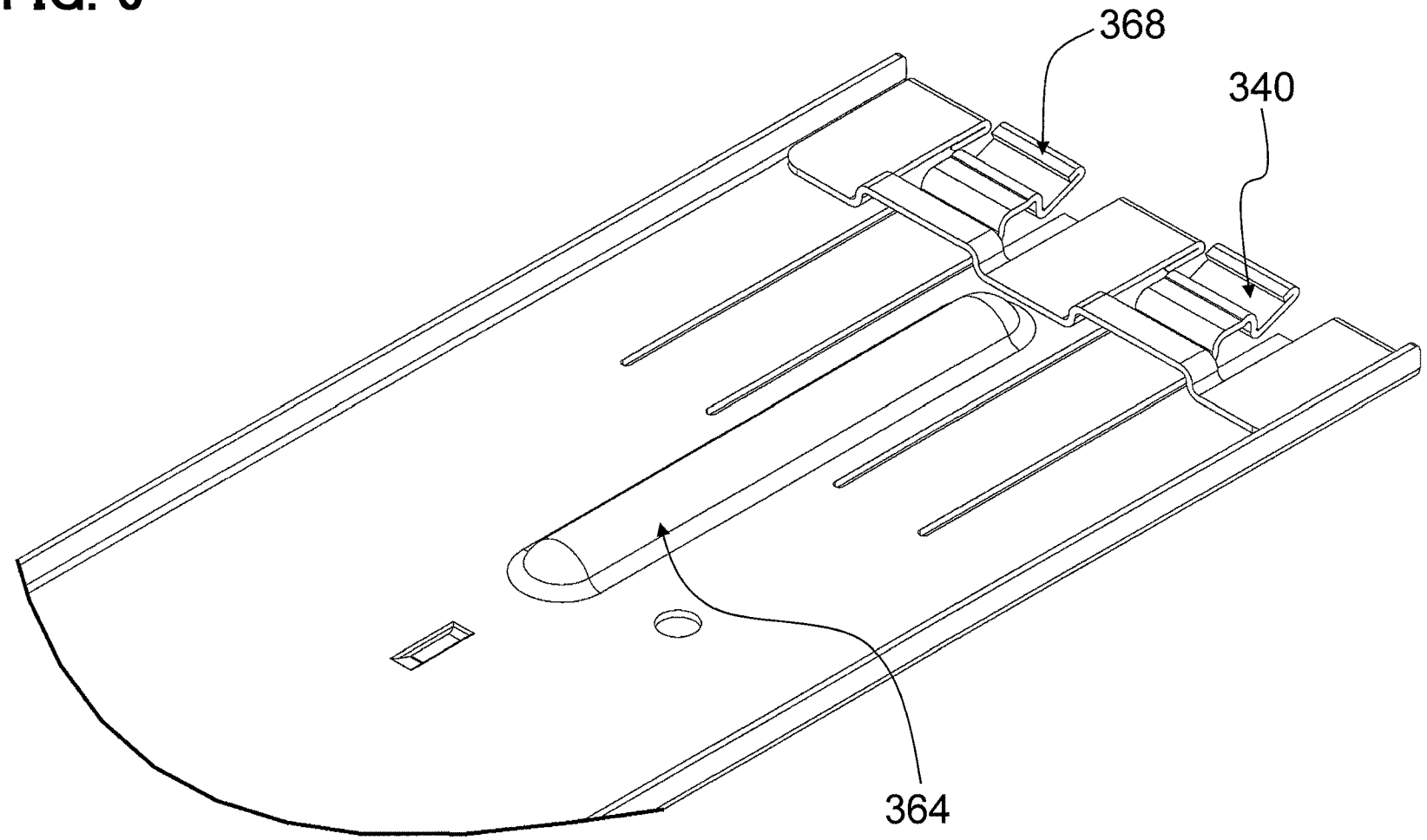
FIG. 6 is a perspective view of an insert of the heat exchanger assembly in a third embodiment of the present disclosure.

With reference to FIG. 6, a third embodiment of the disclosure is similar to the first embodiment. The lead-ins 340 are bent over at their tips to form a hem 368 (second hem). Also, the assembly of the third embodiment includes a swage 364, like the second embodiment.

Fourth Embodiment

Figure 7:
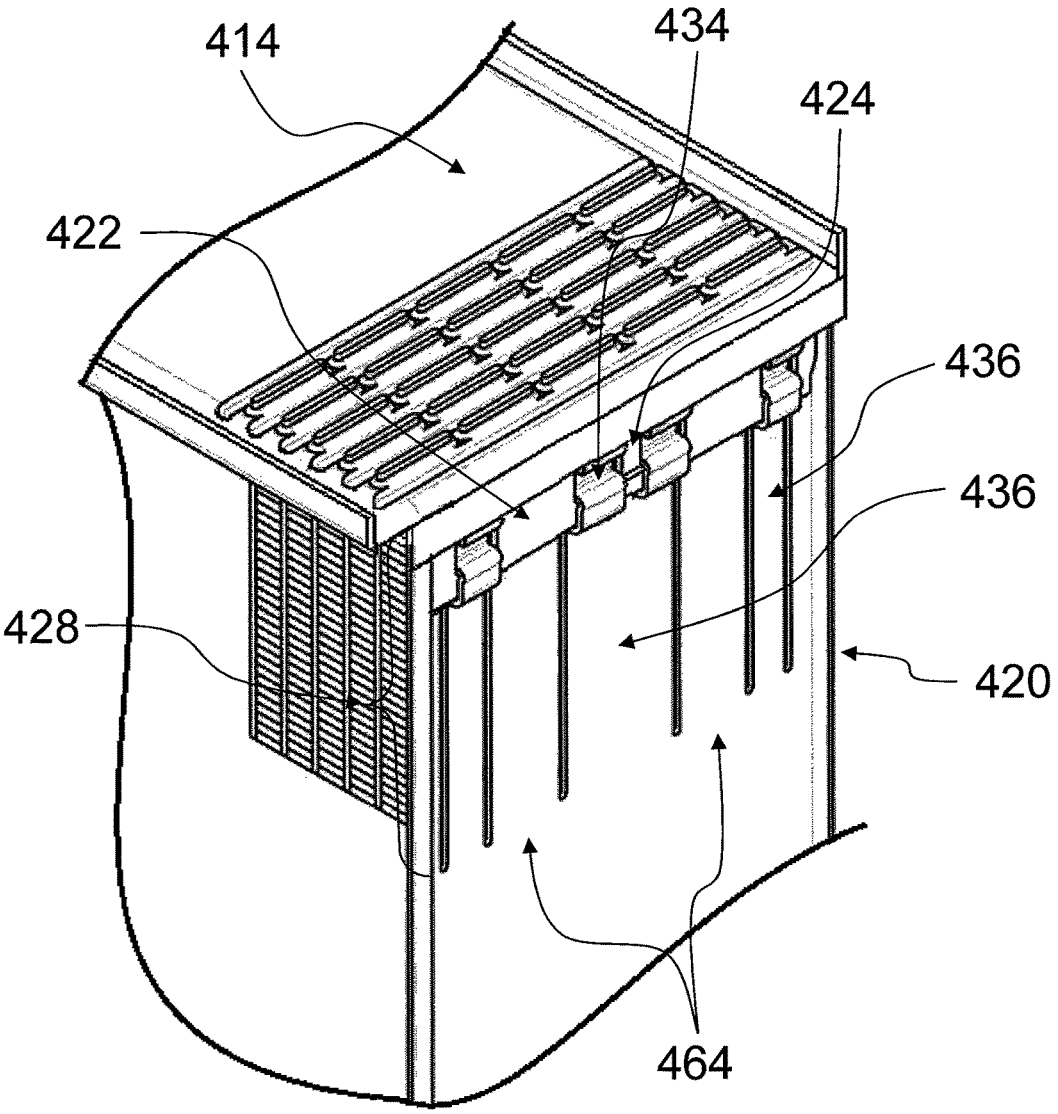
FIG. 7 is a perspective view showing a part of a heat exchanger assembly according to a fourth embodiment of the present disclosure.

With reference to FIG. 7, in a fourth embodiment of the disclosure, the insert 420 includes three resilient arms 428. The central resilient arm 428 is wider than in previous embodiments and comprises a single leaf spring 436 connected to two barbs 434. Each of the two barbs 434 is inserted into a single separate cut-out 424 (e.g., aperture), or catch, arranged on the flange 422 of the header plate 414. The outer two arms 428 are narrower than in previous embodiments. FIG. 7 shows that the swaged ridges 464 can extend intermediate and alongside the leaf springs 436 of the resilient arms 428 up to just below the lower end of the header plate flange when assembled.

Fifth Embodiment

Figure 8:
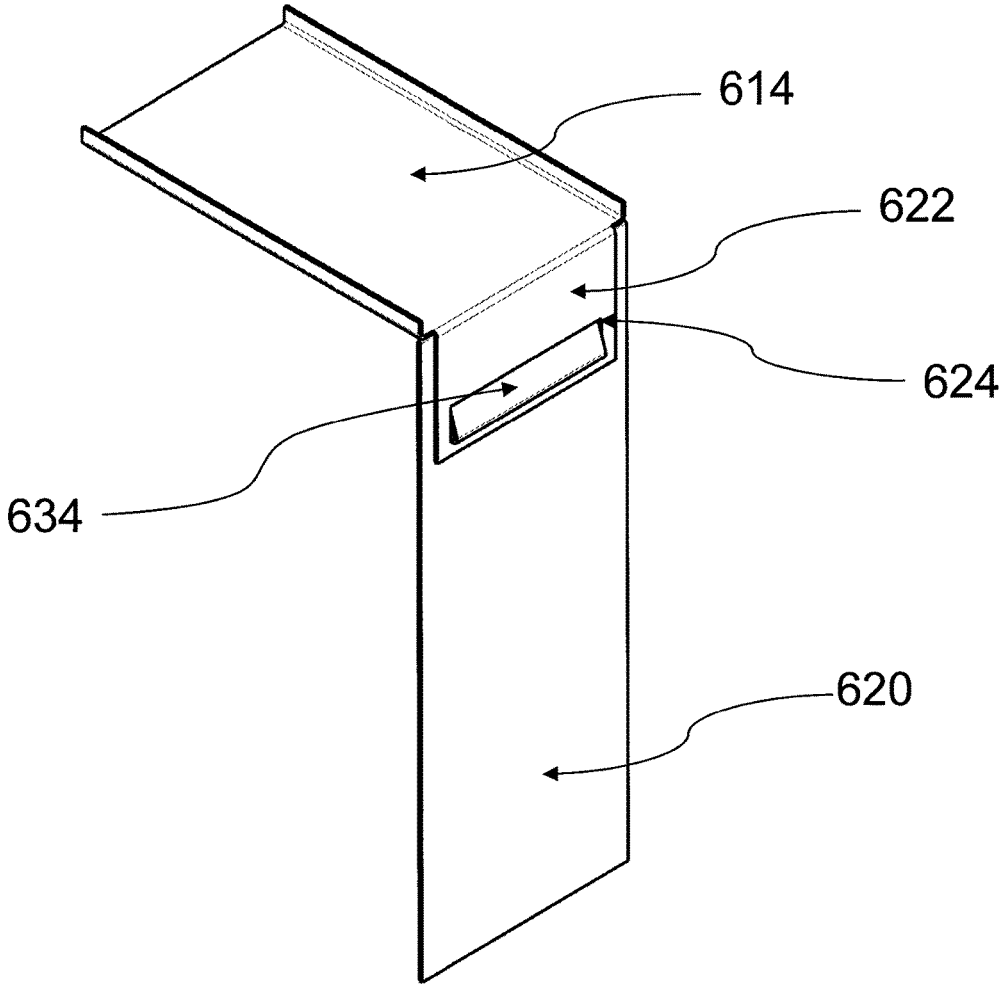
FIG. 8 is a perspective view showing a part of a heat exchanger assembly according to a fifth embodiment of the present disclosure.

With reference to FIG. 8, in a fifth embodiment of the disclosure, the insert 620 includes a single wide barb 634, forming the latch. The flange 622 of the header plate 614 includes a single cut-out 624 (e.g., aperture), comprising the stop forming the catch. The ratio of material gauge to length of the flange 622 allows the flange 622 to act as a resilient arm as seen in the previous embodiments. Upon assembly, the flange 622 slides over the barb 634 until the flexural stiffness of the material of the flange 622 forces the cut-out 624 over the tapered barb 634. There are process benefits when employing a flange 622 as the latch as in the fifth embodiment. For example, simpler press tooling to produce the components will suffice. In the fifth embodiment, the barb 634 is single, but the number of the barbs 634 is not limited to one. The number of the barbs 634 may be multiple. In this case, the number of the cut-outs 624 may be multiple correspondingly, or the cut-out 624 may be a single enlarged one.

Sixth Embodiment

Figure 9:
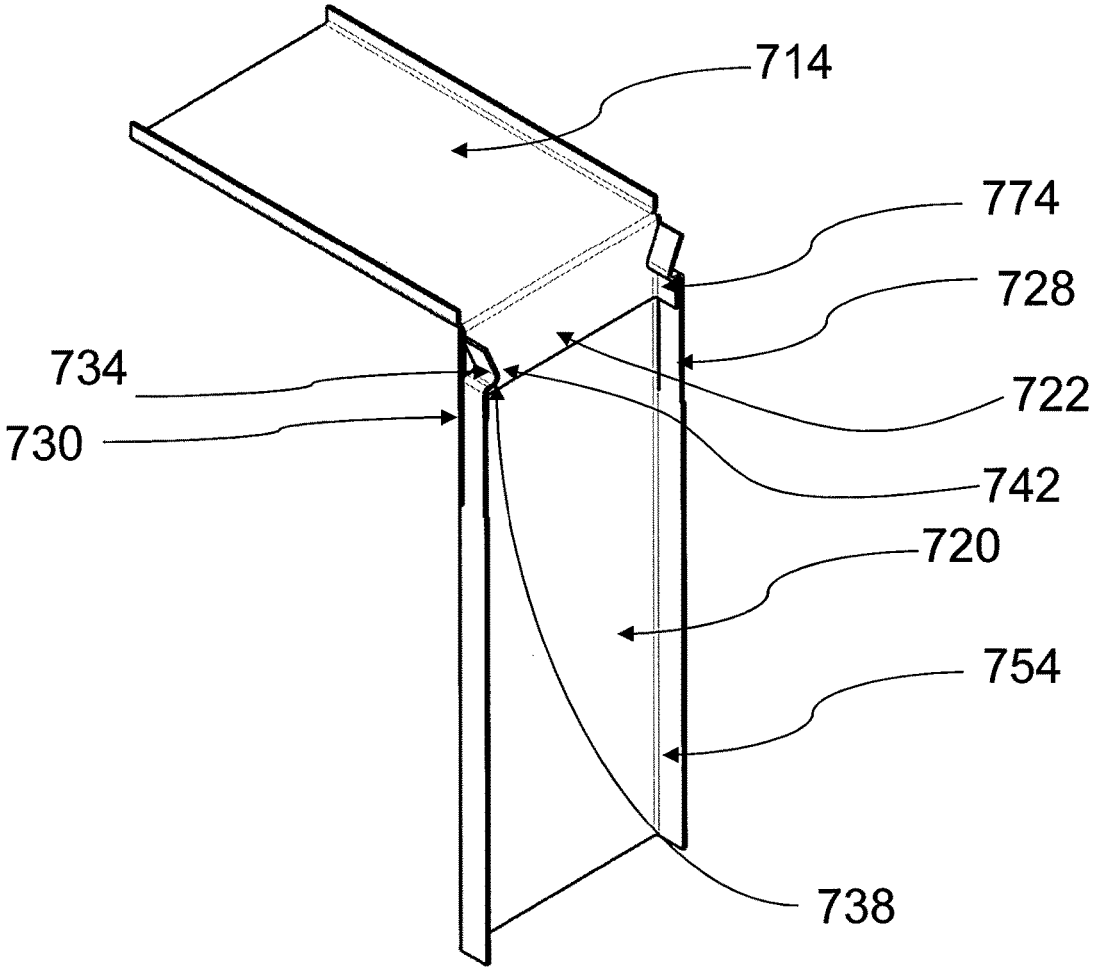
FIG. 9 is a perspective view showing a part of a heat exchanger assembly according to a sixth embodiment of the present disclosure.

With reference to FIG. 9, in a sixth embodiment of the disclosure, the flange 722 of the header plate 714 includes a lug 774 at each side. A cut 730 is formed in the insert 720 from the tip of the insert 720 along each fold line between the main body and the side flange 722. The cuts 730 define the resilient arms 728 which are thus formed from the longitudinal flanges 754. The neutral position of the resilient arms 728 is thus in the same plane as the longitudinal flanges 754. Each resilient arm 728 is bent to form the barb 734. During assembly, the header plate 714 and insert 720 are pressed together such that the resilient arms 728 slide over the lugs 774 and over the barbs 734 forcing the resilient arms 728 to bend outwards. When the apex 742 abuts the lugs 774, maximum deflection occurs because the biasing force acts through the apex 742. When the apices 742 cease to abut the lugs 774, the resilient arms 728 revert back to a neutral position thus snapping the protrusions 738 over the lug 774. As a result, each lug 774 acts as the stop and the protrusion 738 of each barb 734 acts as the latch, which cooperate to form the snap fit connector. Forming the snap fit connector from the insert 720 and header plate 714 ensures that structural integrity is maximised without using a separate component or process for the snap fit connection.

Seventh Embodiment

Figure 10:
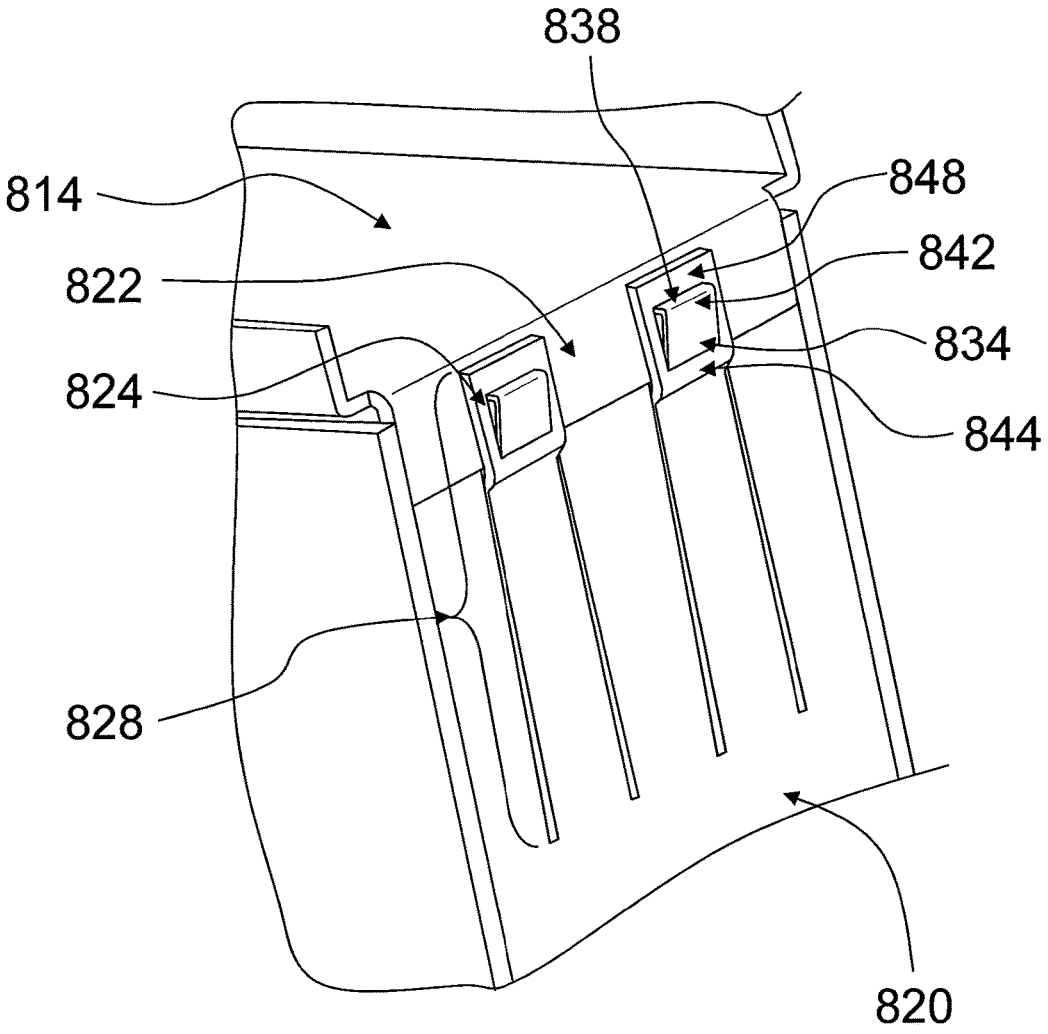
FIG. 10 is a perspective view showing a part of a heat exchanger assembly according to a seventh embodiment of the present disclosure.

With reference to FIG. 10, in a seventh embodiment of the disclosure, the flange 822 of the header plate 814 includes two barbs 834. The insert 820 includes two resilient arms 828 comprising the first joggle 844 only. The contact portion 848 of the joggle 844 defines the cut-out 824 (e.g., aperture).

The stop of the cut-out 824 forms the catch and the protrusion 838 of the barb 834 forms the latch. Upon assembly, the insert 820 is aligned with the flange 822 of the header plate 814. The insert 820 is then pressed together with the header plate 814 which causes the contact portion 848 to slide up over the barb 834. The apex 842 of the barb acts as the point of deflection for the resilient arm 828. Once the apex 842 reaches the cut-out 824, the resilient arm 828 reverts to its neutral position, generally in the plane of the insert 820, thus allowing the stop, or catch, to snap over the protrusion 838, or latch.

Eighth Embodiment

Figure 12:
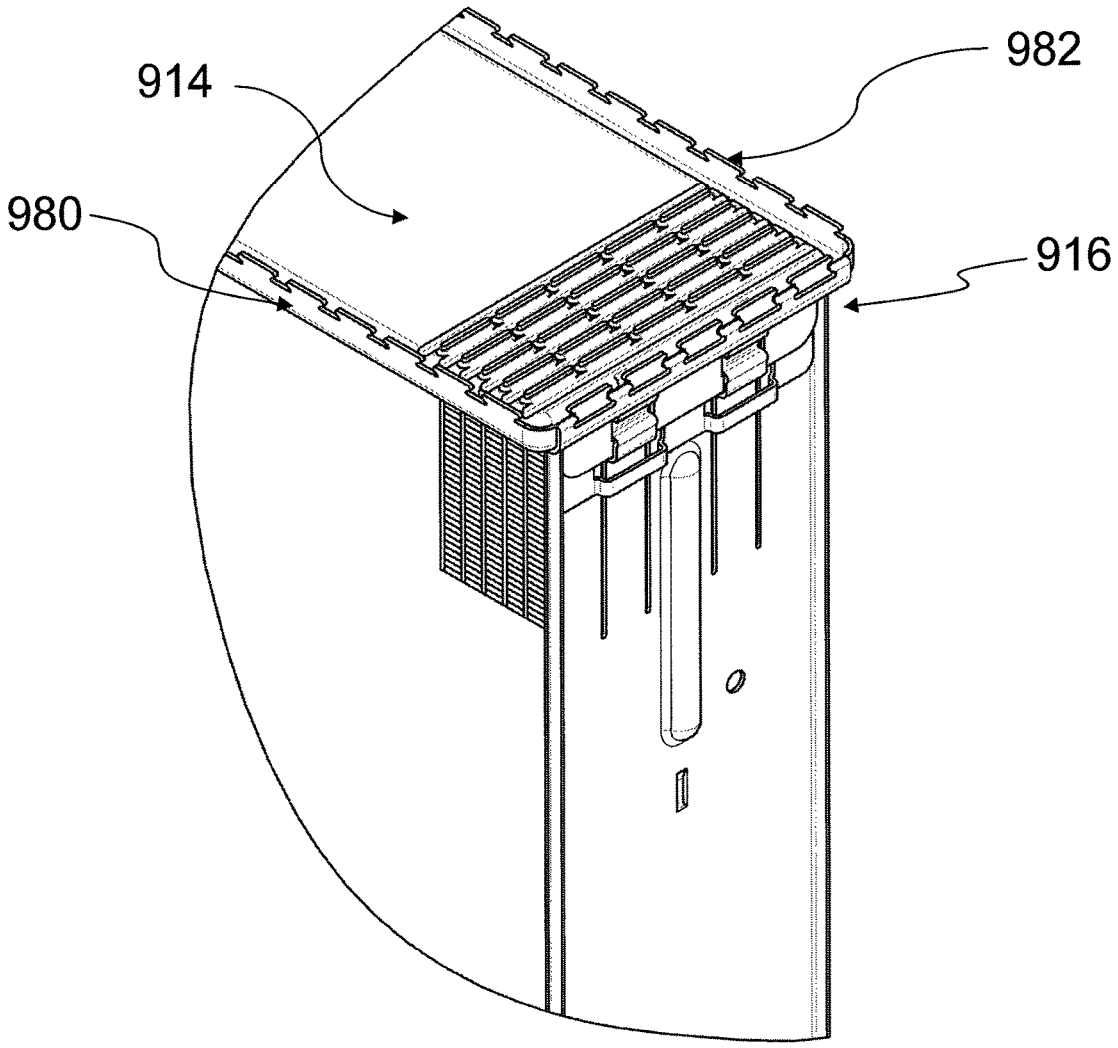
FIG. 12 is a perspective view showing a part of a heat exchanger assembly according to an eighth embodiment of the present disclosure.
Figure 13:
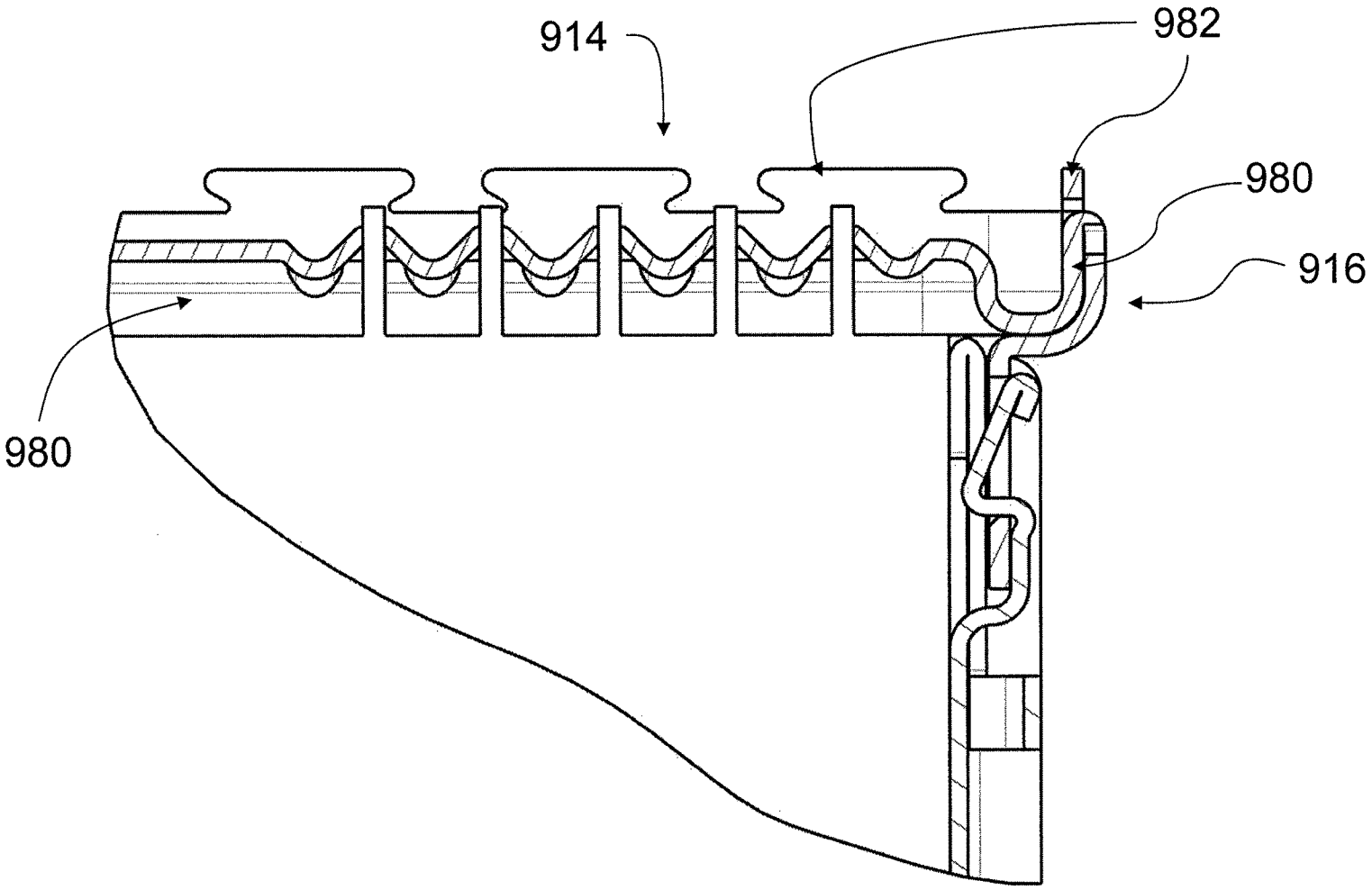
FIG. 13 is an elevation in cross section of part of the heat exchanger assembly of FIG. 12.

With reference to FIGS. 12 and 13, in an eighth embodiment of the disclosure, the header plate is arranged to mount a tank which is crimped to the header plate with a gasket. The header plate 914 includes a bent up rim 980. In this embodiment, the rim instead of being straight has a crenellated edge. Thus, a plurality of male formations 982 are cut out extending upwardly around the rim 980. At the first and second ends 916, 918 of the header plate 914, U shaped cuts are formed in the body of the flange prior to folding down the flange, so that male formations 982 are formed at the ends of the header plate as well.

Figure 14:
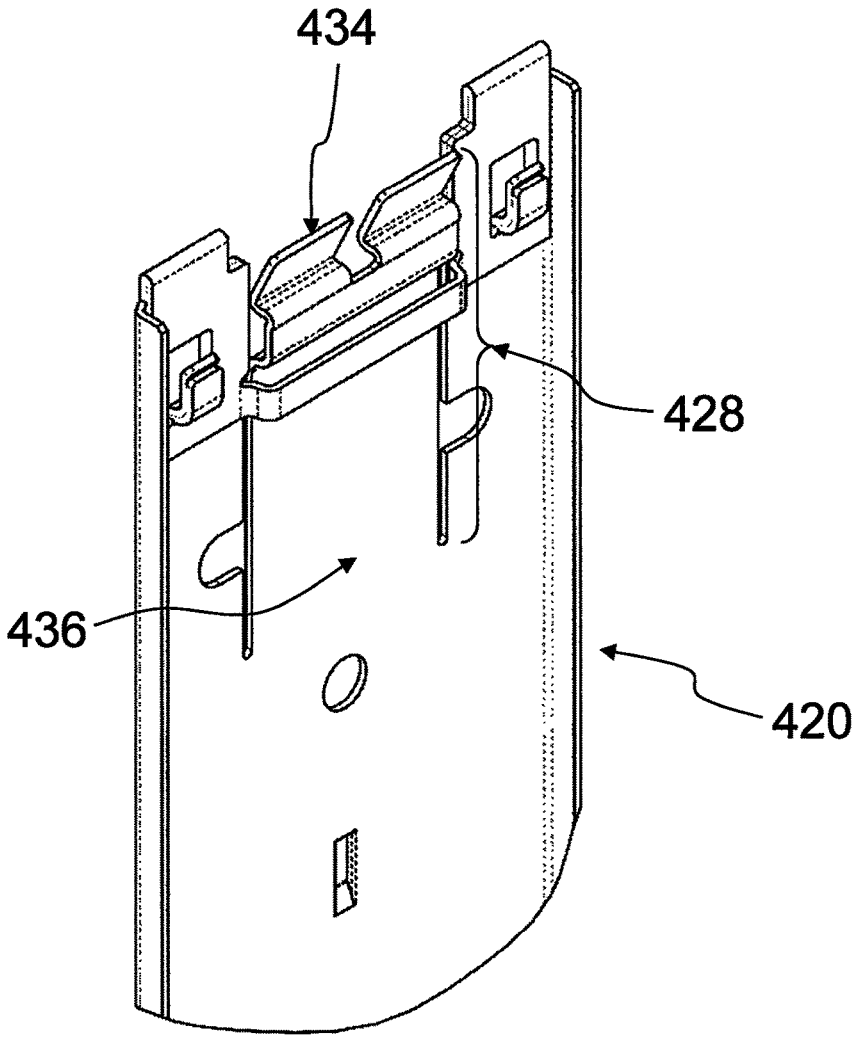
FIG. 14 is a perspective view showing an insert of a heat exchange assembly according to a modification.

Although the embodiments show heat exchangers with five rows of tubes any desired number of rows of tubes, from one to more than five, could be used. In the fourth embodiment, three resilient arms 428 are provided, and the central resilient arm 428 is wider than the outer two arms 428. Alternatively, as shown in FIG. 14, the outer two resilient arms 428 may be omitted.

In the above embodiments, the hemmed tip is provided in the insert, but the hemmed tip may be omitted. In other words, the insert may not be hemmed.

It will be appreciated that, even though the disclosure has been described hereinabove by way of example to multiple embodiments, it is possible to apply some features from one embodiment to another embodiment and that the list is non-exhaustive.

What is claimed is:

1. An assembly forming a heat exchanger or part of a heat exchanger, the assembly comprising:
- a core with at least one insert in a form of a side plate, and
- a header plate attached to the insert by at least one snap fit connection,
- wherein
- the side plate comprises a resilient arm formed in a same plane as a main body of the side plate, and a spanning part which spans over the resilient arm,
- the header plate includes a flange overlapping the side plate,
- the resilient arm defines at least one protrusion and the flange defines at least one stop, the at least one protrusion latching behind the at least one stop to form the snap fit connection,
- such that
- the resilient arm and the spanning part are able to clamp the flange between them.

2. The assembly as claimed in claim 1, wherein the header plate comprises a flange overlapping the side plate and connected thereto.

3. The assembly as claimed in claim 2, wherein the flange is a downwardly turned flange.

4. The assembly as claimed in claim 1, wherein the at least one stop is part of a surface of the insert or header plate defining an aperture.

5. The assembly as claimed in claim 2, wherein the stop is arranged on the flange.

6. The assembly as claimed in claim 1, comprising two of said resilient arms and land therebetween.

7. The assembly as claimed in claim 6, wherein the land between the arms includes strengthening deformation.

8. The assembly as claimed in claim 7, wherein the land comprises an elongate ridge.

9. The assembly as claimed in claim 8, wherein the elongate ridge is formed by swaging.

10. The assembly as claimed in claim 7, wherein the deformation extends beyond a root of the two resilient arms.

11. The assembly as claimed in claim 10, wherein the land between said resilient arms comprises an elongate ridge extending about a same distance in each direction from the root of the resilient arms.

12. The assembly as claimed in claim 1, wherein the resilient arm is arranged to abut the core.

13. The assembly as claimed in claim 1, wherein the insert further comprises a part spanning the resilient arm.

14. The assembly as claimed in claim 13, wherein the spanning part comprises a cage.

15. The assembly as claimed in claim 13, wherein the spanning part comprises a link behind the resilient arm.

16. The assembly as claimed in claim 1, wherein the resilient arm comprises a joggle.

17. The assembly as claimed in claim 1, wherein the resilient arm is made of aluminium.

18. The assembly as claimed in claim 1, wherein additional material forms a first hem on a land between resilient arms.

19. The assembly as claimed in claim 1, wherein the at least one protrusion comprises an angled lead-in.

20. The assembly as claimed in claim 19, wherein the at least one protrusion comprises a barb.

21. The assembly as claimed in claim 19, wherein the at least one protrusion comprises a hemmed tip.

22. The assembly as claimed in claim 1, wherein the insert or the header plate comprises a pocket arranged to retain the other part.

23. The assembly as claimed in claim 1, wherein the insert comprises one or more stiffeners.

24. The assembly as claimed in claim 23, wherein the insert is in the form of an elongate channel.

25. The assembly as claimed in claim 1, wherein
- the header plate comprises a flange in contact with the insert,
- at least one resilient arm is formed from the flange,
- a cut-out from the flange forms a stop, and
- a tapered portion of the insert forms a protrusion to latch behind the stop to form the snap fit connection.

26. The assembly as claimed in claim 25, wherein the flange comprises a lead-in.

27. The assembly as claimed in claim 1, wherein
- the header plate comprises a flange in contact with the insert,
- at least one resilient arm is formed in the insert,
- a stop is formed by a cut-out from the flange.

28. An assembly forming a heat exchanger or part of a heat exchanger, the assembly comprising:
- a core with at least one insert in the form of a side plate, the side plate comprises a resilient arm formed in a same plane as a main body of the side plate, and a spanning part spanning over the resilient arm; and a header plate including a flange, wherein the flange and side plate are overlapping and being connected together by at least one snap fit connection, the resilient arm defines at least one protrusion and the flange defines at least one stop, the at least one protrusion latching behind the at least one stop to form the at least one snap fit connection, so that the resilient arm and the spanning part clamp the flange between them.

29. The assembly as claimed in claim 2, wherein the flange acts as a guide for mounting the header plate on the core.

* * * * *